US008056907B2

(12) United States Patent
Wilson et al.

(10) Patent No.: US 8,056,907 B2
(45) Date of Patent: Nov. 15, 2011

(54) ICE SKATE BLADES

(75) Inventors: Murray David Wilson, Harrow (CA); Steven David Wilson, Harrow (CA); Omer Leon Hageniers, Windsor (CA)

(73) Assignee: 1339513 Ontario Ltd., Ontario (CA)

( * ) Notice: Subject to any disclaimer, the term of this patent is extended or adjusted under 35 U.S.C. 154(b) by 171 days.

(21) Appl. No.: 12/402,838

(22) Filed: Mar. 12, 2009

(65) Prior Publication Data

US 2009/0273149 A1 Nov. 5, 2009

Related U.S. Application Data

(63) Continuation-in-part of application No. 12/114,191, filed on May 2, 2008.

(51) Int. Cl.
*A63C 1/30* (2006.01)

(52) U.S. Cl. ..... 280/11.18; 280/11.12; 280/600

(58) Field of Classification Search ..... 280/11.12, 280/600, 601, 608
See application file for complete search history.

(56) References Cited

U.S. PATENT DOCUMENTS

| | | | | |
|---|---|---|---|---|
| 60,431 | A | 12/1866 | Scott et al. | |
| 83,339 | A | 10/1868 | Thurston | |
| 750,696 | A | 1/1904 | Price | |
| 1,100,976 | A | 6/1914 | Hille | |
| 1,181,831 | A | 5/1916 | Browne | |
| 1,786,553 | A | 12/1930 | Thorngren | |
| 2,055,665 | A | 9/1936 | Moon | |
| 2,181,923 | A | 12/1939 | Smolarek | |
| 2,229,374 | A | 1/1941 | Devau | |
| 2,486,850 | A | 11/1949 | Ives | |
| 2,904,342 | A * | 9/1959 | Jones et al. | 280/11.16 |
| 3,271,906 | A | 9/1966 | Esopi | |
| 3,517,659 | A | 6/1970 | Kane et al. | |
| 3,735,533 | A | 5/1973 | Salberg | |

(Continued)

FOREIGN PATENT DOCUMENTS

CA 1179696 12/1984

(Continued)

OTHER PUBLICATIONS

Office Action dated Oct. 6, 2010 for U.S. Appl. No. 12/114,191, filed May 2, 2008, entitled "Ice Skate Blade Sharpening Machine" to Wilson et al., 20 pages.

(Continued)

*Primary Examiner* — J. Allen Shriver, II
*Assistant Examiner* — Bryan Evans
(74) *Attorney, Agent, or Firm* — Harness, Dickey & Pierce, P.L.C.

(57) ABSTRACT

An ice skate blade for an ice skate comprising a length adapted to be attached to the ice skate and an ice engaging surface adapted to contact ice, a profile extending along at least a portion of the length, the profile having a width between a first side edge and a second side edge. At least one of the side edges ends at a bottom end at the ice engaging surface, a vee is defined by one of the side edges and a flat meeting at the bottom end, wherein a first acute edge angle is formed between the one of the side edges and the flat, and a flat angle is formed between the one of the side edges and a bottom, wherein the bottom has a distance which extends from the flat to either a second flat or a second one of the side edges.

22 Claims, 6 Drawing Sheets

U.S. PATENT DOCUMENTS

| | | | | |
|---|---|---|---|---|
| 3,827,185 | A | 8/1974 | Smith | |
| 4,055,026 | A | 10/1977 | Zwicker | |
| 4,094,101 | A | 6/1978 | Robinson | |
| 4,114,913 | A | 9/1978 | Newell et al. | |
| 4,235,050 | A | 11/1980 | Hannaford et al. | |
| 4,271,635 | A | 6/1981 | Szalay | |
| 4,294,043 | A | 10/1981 | Sakcriska | |
| D264,984 | S | 6/1982 | Olivieri | |
| 4,392,658 | A * | 7/1983 | Redmond et al. | 280/11.18 |
| 4,411,250 | A | 10/1983 | Lach | |
| 4,534,134 | A | 8/1985 | Consay et al. | |
| 4,535,571 | A | 8/1985 | Smith | |
| 4,615,144 | A | 10/1986 | Peacock et al. | |
| 4,722,152 | A | 2/1988 | Ek et al. | |
| 4,756,125 | A | 7/1988 | Kadnar | |
| 4,805,586 | A | 2/1989 | Borse | |
| 4,907,813 | A | 3/1990 | Hall | |
| 5,009,039 | A | 4/1991 | Lager et al. | |
| 5,287,657 | A | 2/1994 | Tschida et al. | |
| 5,354,078 | A | 10/1994 | BelleIsle | |
| 5,431,597 | A | 7/1995 | Anderson | |
| 5,445,050 | A | 8/1995 | Owens | |
| 5,499,556 | A | 3/1996 | Exner et al. | |
| 5,547,416 | A | 8/1996 | Timms | |
| D373,399 | S | 9/1996 | Both | |
| 5,570,893 | A | 11/1996 | Swande | |
| 5,591,069 | A | 1/1997 | Wurthman | |
| 5,704,829 | A | 1/1998 | Long | |
| 5,725,419 | A | 3/1998 | Osthoff et al. | |
| 5,826,890 | A | 10/1998 | Swande | |
| 6,030,283 | A | 2/2000 | Anderson | |
| 6,116,989 | A | 9/2000 | Balastik | |
| 6,203,028 | B1 | 3/2001 | Kress | |
| 6,286,498 | B1 | 9/2001 | Sung | |
| 6,308,700 | B1 | 10/2001 | Lierse | |
| 6,368,198 | B1 | 4/2002 | Sung et al. | |
| 6,422,934 | B1 | 7/2002 | Blach et al. | |
| 6,443,819 | B2 | 9/2002 | Sakcriska | |
| 6,467,778 | B1 | 10/2002 | Goldsmith et al. | |
| 6,481,113 | B1 | 11/2002 | Brenner | |
| 6,619,674 | B2 | 9/2003 | Baldwin | |
| 6,695,322 | B2 | 2/2004 | Goldsmith et al. | |
| D500,112 | S | 12/2004 | Brumpton | |
| 6,830,251 | B2 | 12/2004 | Titzmann | |
| 6,953,390 | B2 | 10/2005 | Sakurai et al. | |
| D514,643 | S | 2/2006 | Henderson | |
| 7,073,810 | B2 * | 7/2006 | Wilson | 280/609 |
| 7,234,709 | B2 | 6/2007 | Lambert | |
| 7,387,302 | B2 | 6/2008 | Goldsmith et al. | |
| D603,432 | S | 11/2009 | Wilson et al. | |
| 7,648,146 | B2 | 1/2010 | Tatomir | |
| D637,676 | S | 5/2011 | Wilson et al. | |
| 2002/0014041 | A1 | 2/2002 | Baldoni et al. | |
| 2003/0106270 | A1 | 6/2003 | Baldoni et al. | |
| 2005/0276979 | A1 | 12/2005 | Slutz et al. | |
| 2007/0001426 | A1 * | 1/2007 | Wade | 280/608 |

FOREIGN PATENT DOCUMENTS

| | | | |
|---|---|---|---|
| CA | 1179696 | A1 | 12/1984 |
| CA | 2173001 | | 3/1996 |
| CA | 2173001 | A1 | 2/1997 |
| CA | 2373449 | A1 | 11/2000 |
| CA | 2373449 | A1 | 11/2000 |

OTHER PUBLICATIONS

Office Action dated Nov. 9, 2010 for U.S. Appl. No. 12/114,191, filed May 2, 2008, entitled "Ice Skate Blade Sharpening Machine" to Wilson et al., 9 pages.

Office Action dated Nov. 26, 2010 for U.S. Appl. No. 12/402,838, filed Mar. 12, 2009, entitled "Ice Skate Blades" to Wilson et al., 20 pages.

Office Action dated Mar. 25, 2011 for U.S. Appl. No. 12/402,838, filed Mar. 12, 2009, entitled "Ice Skate Blades" to Wilson et al., 15 pages.

CA Office Action dated Jun. 8, 2011 for Canadian Application No. 2,630,749, filed May 6, 2008, entitled "Ice Skate Blade Sharpening Machine" to Hageniers et al., 3 pages.

CA Office Action dated Jun. 13, 2011 for Canadian Application No. 2,663,095, filed Apr. 16, 2009, entitled "Ice Skate Blades" to Wilson et al., 2 pages.

Submission of Prior Art Under Provisions of Section 34 for Canadian Application No. 2,630,749 dated Jul. 29, 2011, 141 pages including 6 Exhibits.

Printout purporting to be a portion of Abrasive Technology, Manufacturer of Diamond & CBN Tooling: Resin & Metal Bonded Product Line and including a copyright notice date of 2004 on the final page, 11 pages.

Printout purporting to be a webpage of Norton Abrasives from 2006 and bearing a date of Jul. 29, 2011, 1 page.

Printout purporting to be a portion of Norton Stock Catalog 2005-2006 Diamond Tools and bearing no date, 16 pages.

* cited by examiner

ICE SKATE BLADES

RELATED APPLICATION

This application is a continuation-in-part of U.S. patent application Ser. No. 12/114,191 filed on May 2, 2008.

FIELD OF THE INVENTION

The present invention relates to improvements in ice skate blades, and more particularly to improvements in ice skate blade profiles which enhance skating performance.

BACKGROUND OF THE INVENTION

In winter sports such as ice skating and hockey, the blades of an ice skate are the point of contact for all of the forces generated in turns, spins, jumps, etc. Known ice skate blade profiles typically have a convex shape along a length of the skate blade known as a rocker radius (often along with a second portion near each edge having a second radius or entry radius). Known ice skate blade profiles also have a concave (circular) profile across the bottom of the blade, and this profile defines two edges along the length of the blade. A skater can use either of these two edges in executing maneuvers on the ice surface.

Skate blades for different uses differ from one pair to another. Competing requirements for different applications has made the manufacture of skate blade profiles considered to be part art and part science. The operator of a machine which makes a blade profile is required to first dress the grinding wheel to have the desired contour and then ensure that during the grinding process a centerline of the profile on the wheel coincides with a centerline of the blade along its full length. If this is not done, then an irregular groove will be created along the length of the blade, with one edge being higher/lower than the other.

The dressing of the skate sharpening grinding wheel is traditionally carried out using a single point diamond dresser that is swung in a circular arc across the surface of the spinning grinding wheel about an axis perpendicular to the axis of rotation of the grinding wheel to give the wheel a convex surface with a radius of between ¼ inch and 2 inches. This technique creates the circular arc profile on the grinding wheel for grinding a complimentary concave profile across the width of the skate blade.

Limiting the blade profile to a circular, concave shape restricts a range between the maximum depth of the concave, circular profile, h, and the included angle, θ measured between the vertical side edge and a line formed generally tracking the concave profile near a bottom of the side edge. These two variables, h and θ, are interconnected by the following equation for the edges even condition:

Where:

r—is the radius of the circular arc in the bottom of the skate blade, w—is the width of the skate blade, h—is the maximum depth of the circular arc, θ—is the edge angle between the vertical side edge of the skate blade and a tangent line formed tracking the circular arc at the bottom of the side edge.

$$h=r(1-\cos\{a\sin[w/2r]\}) \quad (1)$$

$$\theta=90°-a\sin(w/2r) \quad (2)$$

For a hockey skate blade, typically w=0.110 inches. Given this limitation on the width, and that the known profiles have a radius, a table can be developed with a list of corresponding r, h and θ values:

| Radius, r (in) | Depth, h (in) | Edge Angle, θ |
|---|---|---|
| 0.250 | 0.00613 | 77.29° |
| 0.500 | 0.00303 | 83.68° |
| 0.750 | 0.00202 | 85.79° |
| 1.000 | 0.00151 | 86.85° |
| 1.250 | 0.00121 | 87.48° |
| 1.500 | 0.00101 | 87.90° |
| 1.750 | 0.00086 | 88.12° |
| 2.000 | 0.00076 | 88.42° |

Smaller radii provide better turning ability along with slower glide speeds, while larger radii provide superior glide speeds along with poorer turning ability. However, with a circular blade profile, the range of edge angles, θ, and depths, h, is very limited. It would be desirable to provide an ice skate blade with profiles having greater variation.

Some alternative ice skate blade profiles are known. For example, Canadian Patent Publication 2,173,001 to Danese discloses an ice skate blade with multiple irregular angled edges along the bottom of the blade. Such an ice skate blade profile is impractical in that it will be very slow and provide poor turning ability. Canadian Patent Publication 1,179,696 to Redmond et al discloses various ice skate blade profiles many of which impractically have a center portion of the bottom extending below the side edges. Below is understood here to refer to the direction towards the ice when a skater is wearing a skate with an ice skate blade. Such ice skate blade profiles will be very unstable and provide questionable lateral control.

SUMMARY OF THE INVENTION

In accordance with a first aspect, an ice skate blade for an ice skate comprises a length adapted to be attached to the ice skate and an ice engaging surface adapted to contact ice, a profile extending along at least a portion of the length, the profile having a width between a first side edge and a second side edge. At least one of the side edges ends at a bottom end at the ice engaging surface, a vee is defined by one of the side edges and a flat meeting at the bottom end, wherein a first acute edge angle is formed between the one of the side edges and the flat, and a flat angle is formed between the one of the side edges and a bottom, wherein the bottom has a distance which extends from the flat to one of a second flat and a second one of the side edges.

From the foregoing disclosure and the following more detailed description of various preferred embodiments it will be apparent to those skilled in the art that the present invention presents a significant advance in the technology of ice skate blade profiles. Particularly significant in this regard is that the invention provides high quality ice skate blade profiles which can be suitably tailored for a wide variety of skating applications. Additional features and advantages of various preferred embodiments will be better understood in view of the detailed description provided below.

Figure 1:
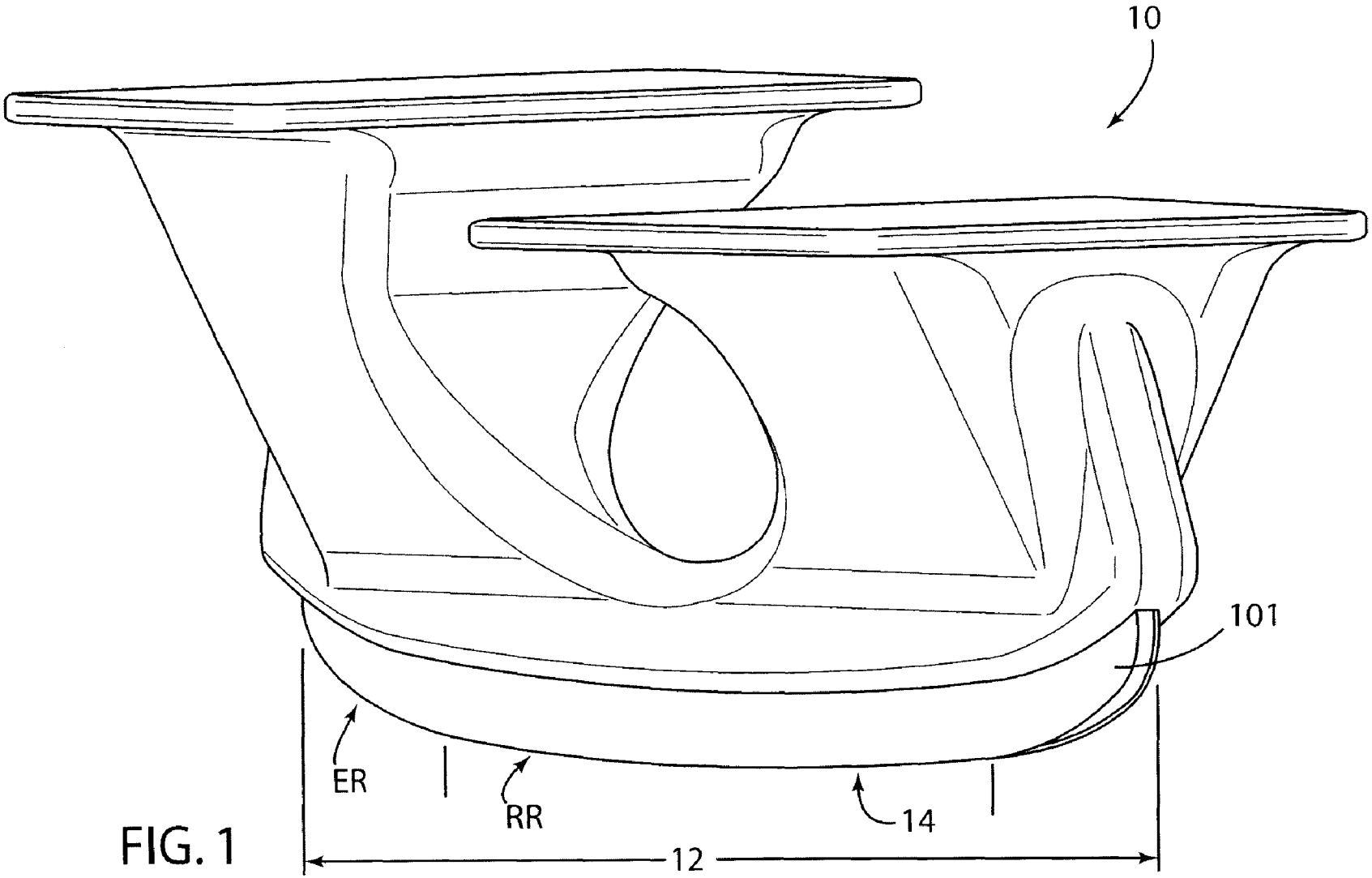
FIG. 1 is an isometric view of an ice skate blade in accordance with one embodiment.

It should be understood that the appended drawings are not necessarily to scale, presenting a somewhat simplified representation of various preferred features illustrative of the basic principles of the invention. Certain features of the illustrated embodiments have been enlarged or distorted relative to others to improve visualization and clear understanding. In particular, thin features may be thickened, for example, for clarity of illustration. All references to direction and position, unless otherwise indicated, refer to the orientation illustrated in the drawing.

DETAILED DESCRIPTION OF CERTAIN PREFERRED EMBODIMENTS

It will be apparent to those skilled in the art, that is, to those who have knowledge or experience in this area of technology that many uses and design variations are possible for the improved ice skate blade profiles disclosed here. The following detailed discussion of various alternatives and preferred features and embodiments will illustrate the general principles of the invention with reference to the ice skate blade groove profiles particularly suited for skaters in hockey, figure skating, and speed skating. Other embodiments suitable for other applications will be readily apparent to those skilled in the art given the benefit of this disclosure.

Turning now to the drawings, FIG. 1 shows an ice skate 10 having an ice skate blade 101 in accordance with one embodiment. The blade has a long length 12 and a shorter width w generally perpendicular to the length. The length may have a rocker radius RR portion and may also have a portion near the ends with a second radius or entry radius ER. Preferably the ice engaging surface 14 has a profile or cross section which is generally the same across its length, and at least across the rocker radius portion of the length. The particular blade profile here may be especially suited for hockey. Alternate ice skate blade profiles, such as those used for speed skating, may be largely flat or have a minimal rocker radius.

Figure 2:
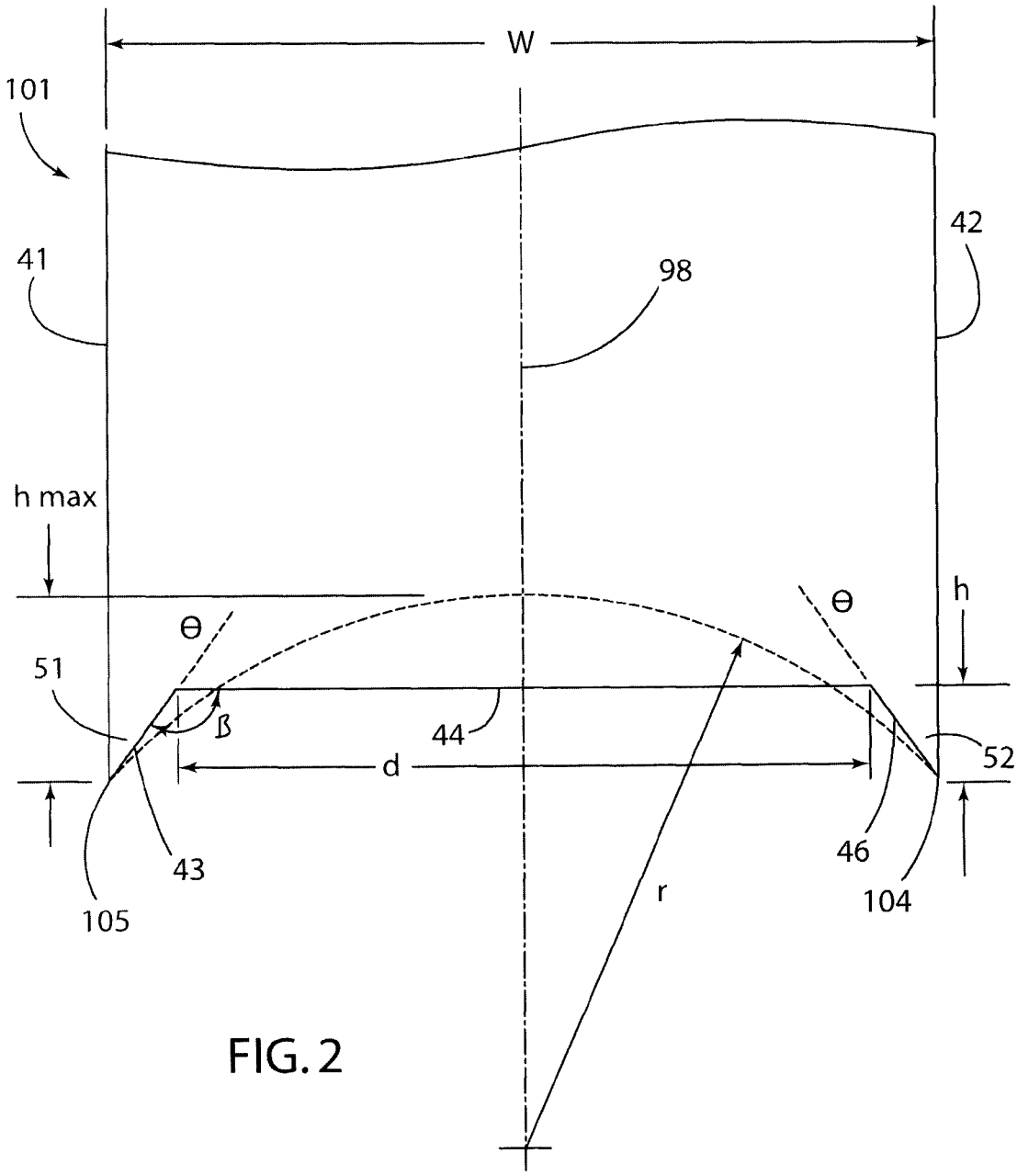
FIG. 2 shows a cross section through an ice skate blade in accordance with one embodiment that has a "bottomed vee" profile on a bottom of the ice skate blade.

FIG. 2 shows a profile or cross section through the rocker radius of the ice skate blade, 101 with a circular arc or arc-shaped groove of radius r is shown in phantom for reference. The phantom groove is not part of the invention, but is shown for contrast as it is the typical shape ground into an ice engaging surface of known ice skate blades using the current technology for sharpening—a cutting tool swung in an arc around a single point. The profile of FIG. 2 can be referred to as the flat bottom vee (abbreviated to FBV) because the two flats 43, 46 would intersect in a vee shape if they were projected upward, and the bottom 44 of the ice skate blade 101 forms a bottom for the vee shape resulting from that projection.

The width of the ice skate blade w is the distance between the two generally vertical side edges 41, 42 of the ice skate blade 101. The height under the blade h is the vertical distance (with vertical understood to be as shown in FIG. 2) between a bottom 44 and the bottom ends 105, 104 of the two blade edges 41, 42 respectively. Vee portions 51, 52 are defined by side edge 41 and flat 43 and by side edge 42 and flat 46. As shown in FIG. 2, the two flats 43, 46 may be formed along lines tangent to the circular arc at bottom ends 105 and 104, respectively. Vees 51, 52 are defined by an acute edge angle θ between the flats 43, 46 and side walls 41, 42, respectively. A flat angle β is formed between each flat 43, 46 and the bottom 44. As shown here, the edge angle θ on both sides of the profile are equal to one another, and the bottom is centered around a centerline 98 of the ice skate blade.

As was noted in the background, the edge angle θ and the maximum height $h_{max}$ under the blade 101 can advantageously be varied by relating the edge angle with the blade width, w, and the groove arc radius r. There are a few geometric properties that define the shape of the FBV ice skate blade profile; the blade width, w, the width of the bottom, d, and the depth of the bottom, h. The edge angle θ at the blade edge, in the case of a symmetrical (central to the blade width) location of the blade bottom 44 (as shown in FIG. 2) is given by the following formula:

$$\theta = a\tan\{(w-d)/2h\} \tag{3}$$

As can be seen from this formula; once a blade width, w, is known, a value of blade bottom width, d, can be chosen in conjunction with the depth of the flat, h, to obtain a wide range of desirable edge angle θ values. For example an ice skate blade 101 having a bottom width d of 0.090 inches can have a depth of flat h of 0.00075 inches. Testing of hockey ice skates with bottom vee profiles has shown that superior ice skating performance can be achieved using bottom vee designs with a width of 0.110" and the bottom distanced ranges from 0.080" to 0.105", and the height is 0.001 to 0.0005". It will be readily apparent to those skilled in the art that the bottom 44 does not have to be perfectly flat but only flat within the manufacturing and machining tolerances associated with crush roll forming tool, its abrasive coating, and the profile transfer processes associated with dressing the grinding wheel and grinding the ice skate blade according to the tooling and process discussed in U.S. patent application Ser. No. 12/114,191 which is hereby incorporated by reference in its entirety.

Figure 3:
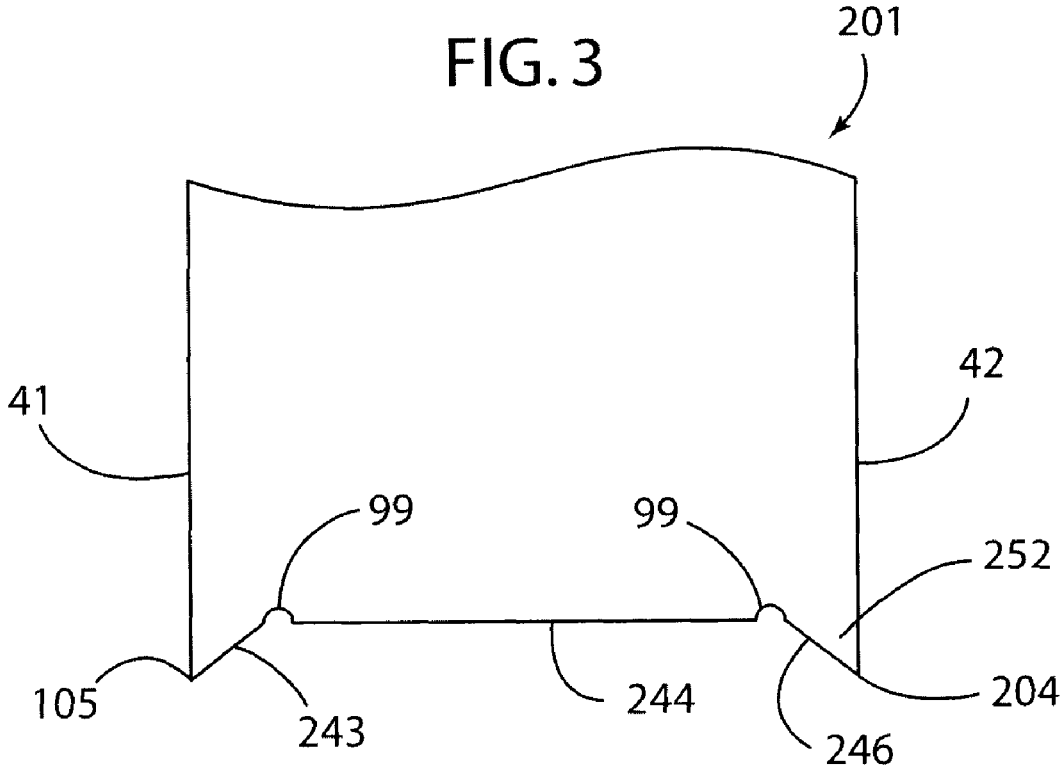
FIG. 3 shows another embodiment with a bottomed vee profile where relief pockets are formed in the bottom of the blade.

FIG. 3 shows another embodiment where the profile or cross section of an ice skate blade 201 is shown with the bottom vee profile of FIG. 2 with the addition of relief pockets 99 between the blade bottom 244 and the flats 245, 246. The relief pockets advantageously help provide an ice chip breaking type action when a user pushes off and provide greater control during stopping. The relief pockets 99 are shown formed as semi-cylinders with a circular arc cross section; other shapes will be readily apparent to those skilled in the art given the benefit of this disclosure.

Figure 4:
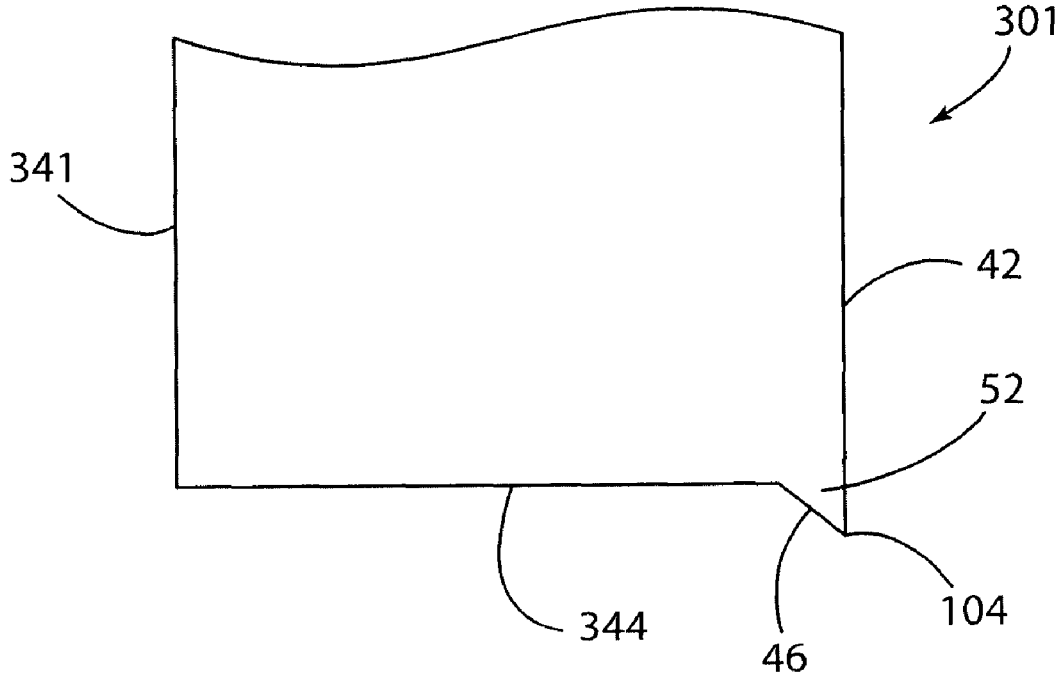
FIG. 4 shows an embodiment with a single vee.

FIG. 4 shows another embodiment where the profile or cross section through an ice skate blade 301 is asymmetrical. Side edge 42 with bottom end 104, flat 46 and vee 52 remain the same as the embodiment in FIG. 2. However, side edge 341 does not have a bottom end which helps define a vee.

Bottom 344, instead of extending between flats, now extends between one flat 46 and one of the side edges 341. The profile of FIG. 4 has the profile of FIG. 2 on one side only. The height is measured in a manner similar to the embodiment of FIG. 2. As bottom 344 is linear in cross section (and curved along the length), a vertical distance is defined between a point formed by a line extending collinearly from the bottom 344 to the side edge 42 and the bottom end 104 as shown in FIG. 4. The profile of FIG. 4 has significant potential for speed skating, where all of the turns are in one direction and the blade side edge 42 be used on the inside edge of the skate blade to provide greater cornering ability. The presence of the blade side edge will provide greater drag than the completely flat blades presently used for speed skating. However, the improved ability to corner as well as the better ability to push off during power strokes will provide superior performance to speed skaters.

Figure 5:
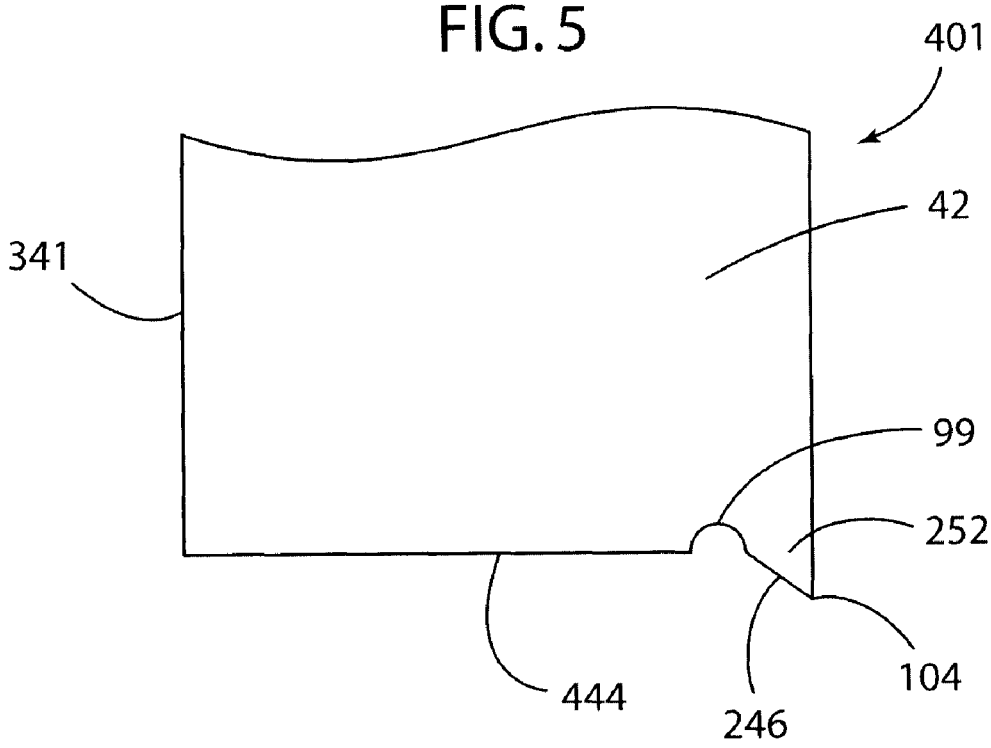
FIG. 5 shows an embodiment with a single vee and a relief pocket.

FIG. 5 is another embodiment similar to FIG. 4, most suitable for speed skating, with the addition to the ice skate blade 401 of one of the relief pockets 99 of FIG. 3 between the blade bottom 344 and one of the flats 243, 246. The relief pocket advantageously helps provide an ice chip breaking type action when a user pushes off and provide greater control during stopping.

Figure 6:
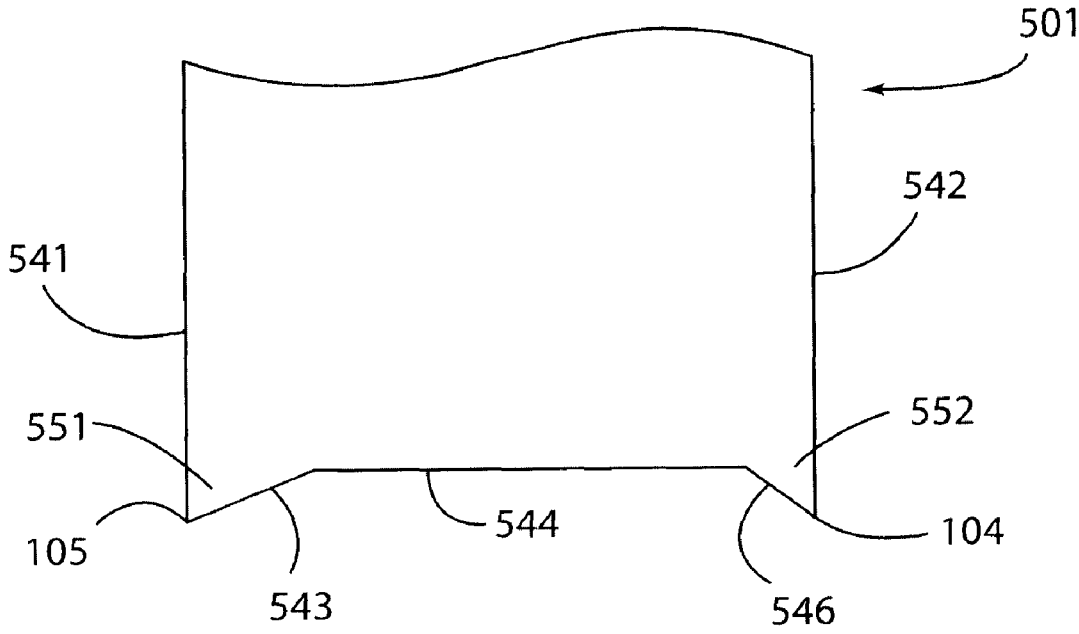
FIG. 6 shows another embodiment with non-identical edge angles.

FIG. 6 shows another embodiment of a profile or cross section through an ice skate blade 501 wherein the vees 551, 552 and therefore the edge angles between the flats 543, 546 and the bottom 544 are not the same. The bottom 544 of the blade profile is not symmetrical with respect to the blade centerline established as the half way point between the two blade side edges 541, 542. It is anticipated that the ice skate blade profile shown in FIG. 6 with a first blade edge angle different than a second edge angle would provide improved performance for a hockey goalie, particularly if the sharper edge is on the inside of both skate blades, allowing for better penetration of the ice to provide a stronger side ways push during lateral goalie movements.

Figure 7:
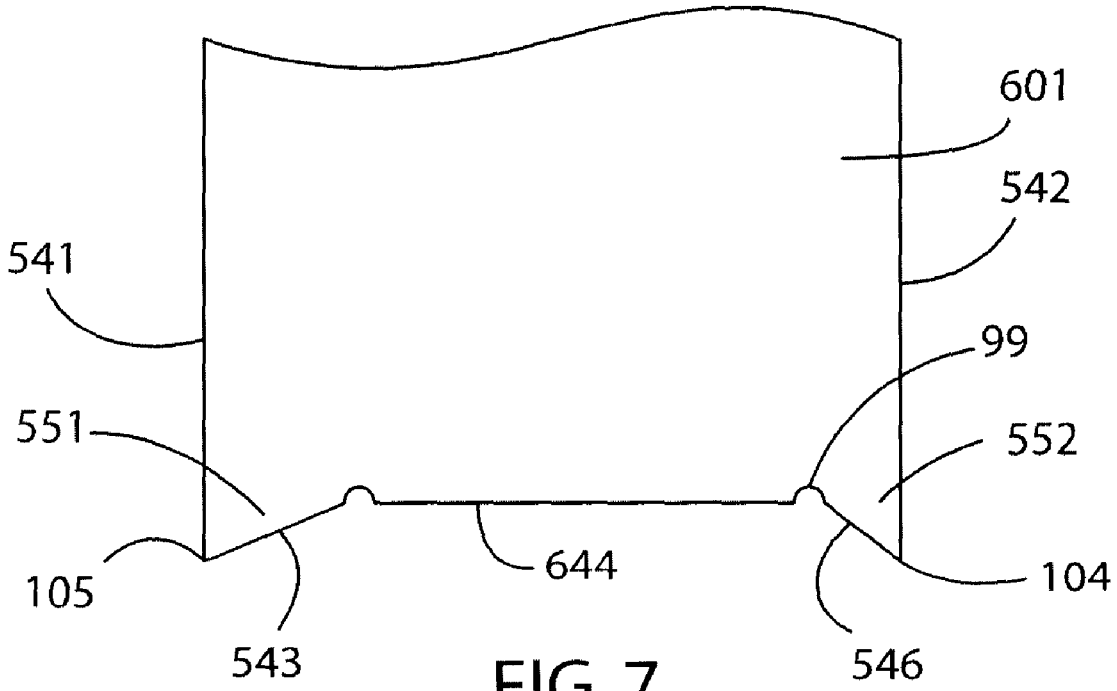
FIG. 7 shows another embodiment with non-identical edge angles and relief pockets.

FIG. 7 is another embodiment similar to FIG. 6, with the addition to the ice skate blade 601 of the relief pockets 99 of FIG. 3 between the blade bottom 644 and the flats 543, 546. The relief pockets advantageously help provide an ice chip breaking type action when a user pushes off and provide greater control during stopping.

Figure 8:
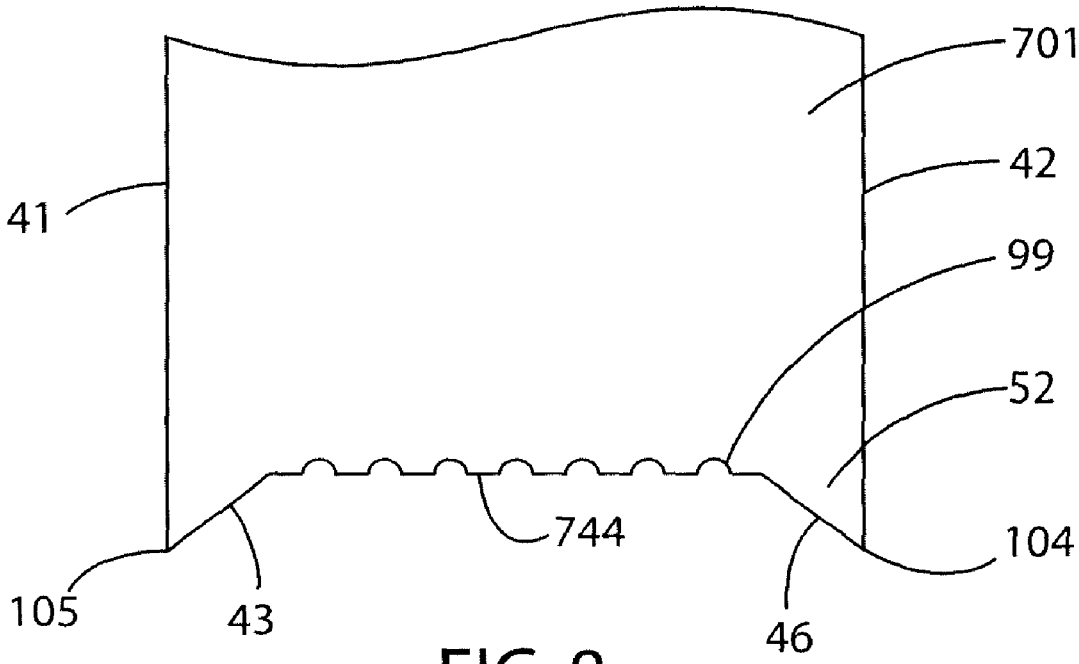
FIG. 8 shows a cross section of an ice skate blade that has a bottom vee profile with a multiplicity of relief grooves ground into the bottom of the blade.

FIG. 8 shows another embodiment of a profile or cross section through an ice skate blade 701 with the symmetrical bottom vee profile of FIG. 2 and the additional feature of a plurality of relief pockets 99 across the width of the bottom 744. The number, location, depth and precise shape of the relief pockets can be varied dependent upon the exact effect required. The relief pockets are present for two purposes; to provide channels for the passage of water and to provide passages for ice chips or other debris on the ice surface. While the presence of multiple relief pockets in the blade bottom is shown for the bottom vee profile it will be readily understood by those skilled in the art and given the benefit of this disclosure that multiple relief pockets may be applied to the bottom of any of the other blade groove profiles disclosed herein.

Figure 9:
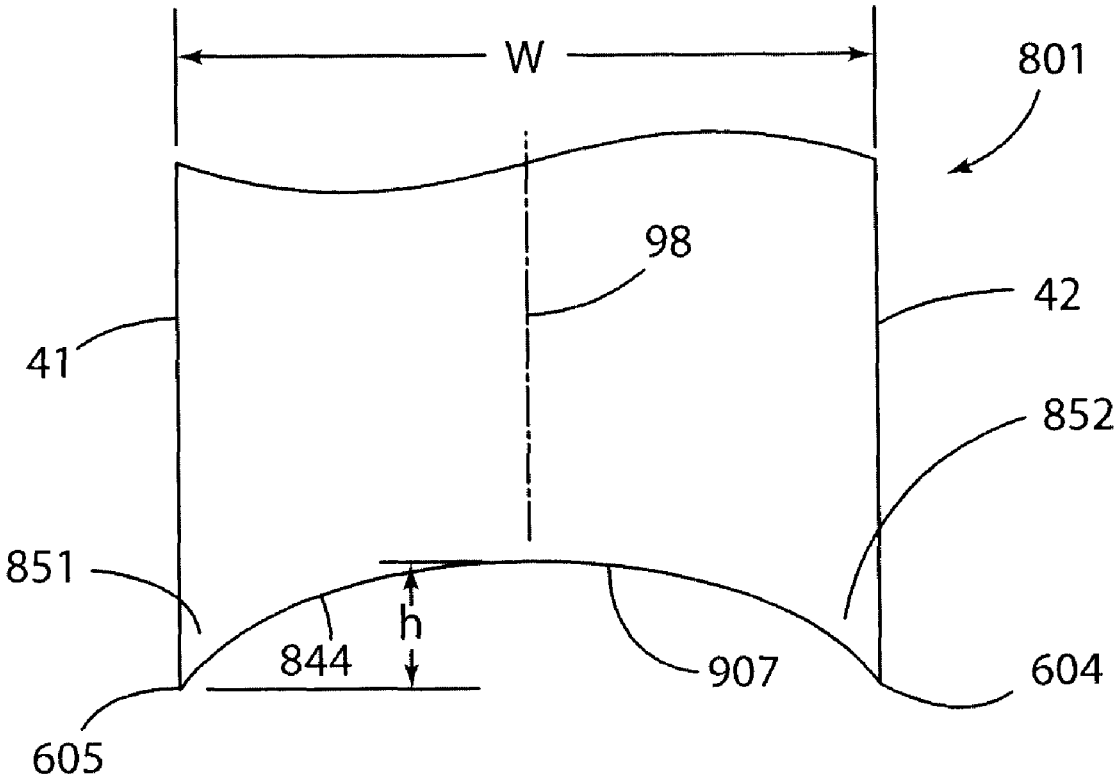
FIG. 9 shows an alternate bottom of the bottom of an ice skate blade that has an elliptical cross section.

FIG. 9 shows another embodiment of an ice skate blade 801 having an elliptical bottom 844 combining the bottom and the flats of other embodiments. Ellipses have a major axis and a minor axis. The major axis is on the line formed between the two blade side edges 41, 42, while the minor axis is on the centerline of the skate blade, half way between the side edges of the blade. For an elliptical shape that has an x axis defined along the line joining the two blade side edges and a y axis located along the centerline 98 of the blade it is possible to describe the profile in mathematical terms as:

$$(2x/w)^2+(y/h)^2=1 \tag{4}$$

Where: w is the width of the ice skate blade 801 and h is the maximum height of the profile under the skate blade or more precisely a vertical distance between a line tangent to the ellipse at the centerline and a line formed between the bottom ends 604, 605. The variables x and y are understood to be standard references with respect to the view in FIG. 9. Since the value of the height of the profile under the blade h can be varied independently from the blade width, w, it is possible to create ice skate blade profiles, 801, with any value of height, h, under the blade, all with edge angles of zero.

There are however two practical considerations that must be addressed in grinding an elliptical profile 601 on the bottom of the ice skate blade, 101. These practical considerations are; first, the width, w, of all skate blades has a nominal value for each of the ice sports. In hockey, hockey goalie, figure skating, and speed skating, there is variation in tolerance for the blade width w within each sport classification. Also, an edge angle of 0° is not practical as it will have zero width at the blade side edge, with a resultant tendency for the edge to break off. In order to overcome these limitations in a practical manner, the x axis of the ellipse described above can be lowered by an amount d below the line joining the two blade bottom edges 604, 605, and the length of the elliptical axis along the x axis can be increased by an amount 2*a*. This ellipse will have the following equation:

$$\{x/(w/2+a)\}^2+\{y/(h+d)\}^2=1 \tag{5}$$

Where all of the terms in the equation for the ellipse are defined as noted above. The blade bottom edges 604, 605, will be located at the coordinate points (w/2, d) and (−w/2, d). The edge angle θ can then be calculated as:

$$\theta=90°+a\tan[(h+d)\{[(w/2)/(w/2+a)]/[1-[(w/2)/(w/2+a)]^2]^{1/2}\}] \tag{6}$$

The edge angle θ is shown below to have a preferred range of about 62° to 87° for several combinations of a, d, h, with w=0.110 inches as is typical for hockey skates.

| Distance, d inches | Distance, a inches | Depth, h inches | Edge Angle, θ° |
|---|---|---|---|
| 0.010 | 0.001 | 0.001 | 62.20 |
| 0.010 | 0.002 | 0.001 | 69.64 |
| 0.010 | 0.003 | 0.001 | 73.21 |
| 0.050 | 0.001 | 0.001 | 75.09 |
| 0.050 | 0.002 | 0.001 | 79.39 |
| 0.050 | 0.003 | 0.001 | 81.34 |
| 0.020 | 0.001 | 0.001 | 83.74 |
| 0.020 | 0.002 | 0.001 | 85.59 |
| 0.020 | 0.003 | 0.001 | 86.41 |

The fact that the height under the profile h, and the edge angle (θ), can be varied independently allows elliptical profiles, 601, to be selected that can provide superior performance over known circular arc profiles.

The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An ice skate blade for an ice skate comprising, in combination:

a length adapted to be attached to the ice skate and an ice engaging surface adapted to contact ice;

a single profile extending along at least a portion of the length, the profile having a width between a first side edge and a second side edge, wherein at least one of the side edges ends at a bottom end at the ice engaging surface; and a vee defined by one of the side edges and a flat meeting at the bottom end, wherein a first acute edge angle is formed between the one of the side edges and the flat;

and a flat angle is formed between the flat and a bottom, wherein the bottom has a distance which extends from the flat to one of a second flat and a second one of the side edges.

2. The ice skate blade of claim 1 wherein the bottom is linear in cross section across the width, and a height is defined by a distance between a point formed by a line extending collinearly from the bottom to one of the side edges and the bottom end of the same side edge.

3. The ice skate blade of claim 1 wherein the length comprises a rocker radius and at least one entry radius, and the profile extends along the rocker radius.

4. The ice skate blade of claim 3 wherein the profile extends along the entry radius.

5. The ice skate blade of claim 1 wherein both of the edges end at a bottom end at the ice engaging surface.

6. The ice skate blade of claim 5 further comprising a second vee defined by the other of the side edges and the second flat meeting at the second bottom end, wherein a second acute edge angle is formed between the other of the side edges and the second flat.

7. The ice skate blade of claim 6 further comprising relief pockets positioned between the bottom and each of the flats.

8. The ice skate blade of claim 1 further comprising a relief pocket positioned between the bottom and the flat.

9. The ice skate blade of claim 1 further comprising a plurality of relief pockets positioned along the bottom.

10. The ice skate blade of claim 6 wherein the second acute edge angle is different than the first acute edge angle.

11. The ice skate blade of claim 10 further comprising relief pockets positioned between the bottom and each of the flats.

12. The ice skate blade of claim 2 wherein the width is 0.110 inches and the bottom distance ranges from 0.080" to 0.105" and the height is 0.001 to 0.0005".

13. The ice skate blade of claim 2 further comprising a centerline defined as the midpoint between the side edges along the width, and the bottom is symmetrical about the centerline.

14. The ice skate blade of claim 1 wherein the bottom and the flat combine to form an elliptical bottom having the shape of an ellipse with a pair of non-identical focal points.

15. The ice skate blade of claim 14 wherein the first acute side angle and a second acute side angle is formed between the side edges and the elliptical bottom, and the first angle and the second angle range from 62° to 87°.

16. A single ice skate blade comprising:

a first side wall and a second side wall opposite the first side wall;

a flat bottom disposed between the first side wall and the second side wall;

a first flat formed between the flat bottom and the first side wall, the first flat forming a first flat angle with the flat bottom;

a second flat formed between the flat bottom and the second side wall, the second flat forming a second flat angle with the flat bottom, the second flat angle is about equal to the first flat angle;

a first bottom edge formed at a junction of the first side wall and the first flat;

a second bottom edge formed at a junction of the second side wall and the second flat;

a first vee formed from the first side edge, the first bottom edge, and the first flat, the first vee defines a first edge angle between the first flat and the first side edge; and a second vee formed from the second side edge, the second bottom edge, and the second flat, the second vee defines a second edge angle between the second flat and the second side edge, the second edge angle is about equal to the first edge angle, the flat bottom, the first side wall, the second side wall, the first vee, and the second vee are a unitary structure.

17. The ice skate blade of claim 16 wherein a first distance defined between a center line and where the first flat contacts the flat bottom and a second distance between where the second flat contacts the flat bottom and the center line are about equal.

18. The ice skate blade of claim 16 wherein the first side wall, the second side wall, the first vee, the second vee, and the flat bottom are formed from a single piece of metal.

19. The ice skate blade of claim 6 wherein the length adapted to be attached to the ice skate, the vee, and the second vee are formed from a single piece of metal.

20. A single ice skate blade comprising:

a first side wall and a second side wall opposite the first side wall;

a flat bottom disposed between the first side wall and the second side wall;

a first flat formed between the flat bottom and the first side wall, the first flat forming a first flat angle with the flat bottom;

a second flat formed between the flat bottom and the second side wall, the second flat formed adjacent the flat bottom on an opposite side of a center line from the first flat, the second flat forming a second flat angle with the flat bottom;

a first bottom edge formed at a junction of the first side wall and the first flat;

a second bottom edge formed at a junction of the second side wall and the second flat;

a first vee formed from the first side edge, the first bottom edge, and the first flat, the first vee defines a first edge angle between the first flat and the first side edge; and a second vee formed from the second side edge, the second bottom edge, and the second flat, the second vee defines a second edge angle between the second flat and the second side edge, wherein a first line that extends parallel to the first flat intersects with a second line that extends parallel to the second flat, the first line intersects the second line at the center line.

21. The ice skate blade of claim 20 wherein a first distance defined between the center line and where the first flat contacts the flat bottom and a second distance between where the second flat contacts the flat bottom and the center line are about equal.

22. The ice skate blade of claim 20 wherein the first side wall, the second side wall, the first vee, the second vee, and the flat bottom are formed from a single piece of metal.

* * * * *